United States Patent [19]

Broyles

[11] Patent Number: 5,046,206

[45] Date of Patent: Sep. 10, 1991

[54] COMBINED BED CHAIR, TRAY, AND FOOTREST

[76] Inventor: James H. Broyles, 2286 Hickory Dr., Culpeper, Va. 22701

[21] Appl. No.: 641,302

[22] Filed: Jan. 15, 1991

[51] Int. Cl.[5] ..... A47C 20/02

[52] U.S. Cl. ..... 5/432; 5/507; 108/49

[58] Field of Search ..... 5/431, 432, 445, 503, 5/507; 297/217; 108/49

[56] References Cited

U.S. PATENT DOCUMENTS

| | | | |
|---|---|---|---|
| 2,445,619 | 7/1948 | Josephs | 5/432 |
| 2,529,350 | 11/1950 | Posz | 5/432 |
| 2,802,220 | 8/1957 | Locke | 5/432 |
| 3,167,790 | 2/1965 | Hickey | 5/432 X |
| 3,176,322 | 4/1965 | Mulchahy | 5/503 |
| 3,230,557 | 1/1966 | Hale | 5/432 |
| 3,299,443 | 1/1967 | Rucchio | 5/432 |
| 3,668,723 | 6/1972 | Bratton | 5/432 |

*Primary Examiner*—Michael F. Trettel
*Attorney, Agent, or Firm*—Everette A. Powell, Jr.

[57] ABSTRACT

A combination bedchair, tray, and footrest construction for use of invalids to enable them to sit up in bed with secure back and foot support. The bedchair has no bottom and is provided with a back member and side or arm members which are secured to a removable table and footrest frame device which is also secured to a siderail of the bed.

6 Claims, 4 Drawing Sheets

COMBINED BED CHAIR, TRAY, AND FOOTREST

BACKGROUND OF THE INVENTION

This invention relates to a lightweight and portable combination bedchair, tray, and footrest construction for use with invalids or patients which will support the patient in a sitting position on a bed and which will securely hold the patient in such a position without the danger of falling or slipping from the chair and the bed.

As is well known to those familiar with the nursing profession, many people suffer from disabling sickness which requires many weeks in bed. Also, many of the older generation become weak and infirm and must spend long hours in bed. In all such cases it is often desirable from the standpoint of the patient's comfort, as well as from the need of therapy to enable the patient to be placed in a sitting position.

In many instances, this requires removing the patient from the bed and placing him a chair. This is a very difficult task, usually requiring several attendants and often special equipment.

Because of the workloads of the attendants in hospitals and nursing homes, it is not always possible to place the patient in a sitting position as often as desired, or to place him back in bed when necessary.

In the past attempts have been made to provide bedchairs for use by invalids or patients to enable them to be placed in a sitting position without being removed from the bed. Many of these prior art devices do not provide sufficient support for the patient, are expensive to manufacture, and/or require a substantial amount of handling and assembly around the patient.

There is presently a need for a light-weight, simple, reliable bedchair support device which may be readily placed about, and in front of, the patient and safely secured in position relative to the bed and the patient by a single attendant with little difficulty, and which will support the patient without slipping or falling into uncomfortable positions or out of the chair.

PRIOR ART

In the prior art, U.S. Pat. No. 3,167,790 to Hickey discloses an invalid bedseat; U.S. Pat. No. 3,335,434 to Gamon discloses a bedchair construction; U.S. Pat. No. 3,522,616 to Saldo et al discloses an invalid bedchair; U.S. Pat. No. 3,668,723 to Bratton discloses a patient riser; and German Patent No. 76,499 to Schwan discloses a bedchair and footrest secured to a bedrail.

OBJECTS OF THE INVENTION

Accordingly, it is an object of this invention to provide an improved lightweight and comfortable back and arm support bedchair for use in bed to safely support an invalid in a sitting position on the side of the bed.

A further object of this invention is to provide a bedchair which may be readily placed about a patient while in a sitting position in a bed, together with cushions if desired, and secured to the bed so as to support the patient without the danger of falling.

A still further object of this invention is to provide a bedchair and support device which will safely and comfortably support a patient in a sitting position on the side of a bed while providing a strong and stable lower support for the lower limbs and feet thereof and an upper table or tray surface for eating, reading, or doing handwork as desired.

SUMMARY OF THE INVENTION

In carrying out this invention in one form, a bedchair, tray, and footrest, combination device for invalids is provided which comprises a table or tray and footrest frame, which is adapted to be releasably secured to the side of the bed, and a bottomless bedchair having a back member and a pair of side arms which are adapted to be releasably connected to the table and footrest frame, such that the patient can sit on the side of the bed, be supported by the bedchair and footrest and use the table in front of him as desired.

DETAILED DESCRIPTION OF PREFERRED EMBODIMENT

Figure 1:
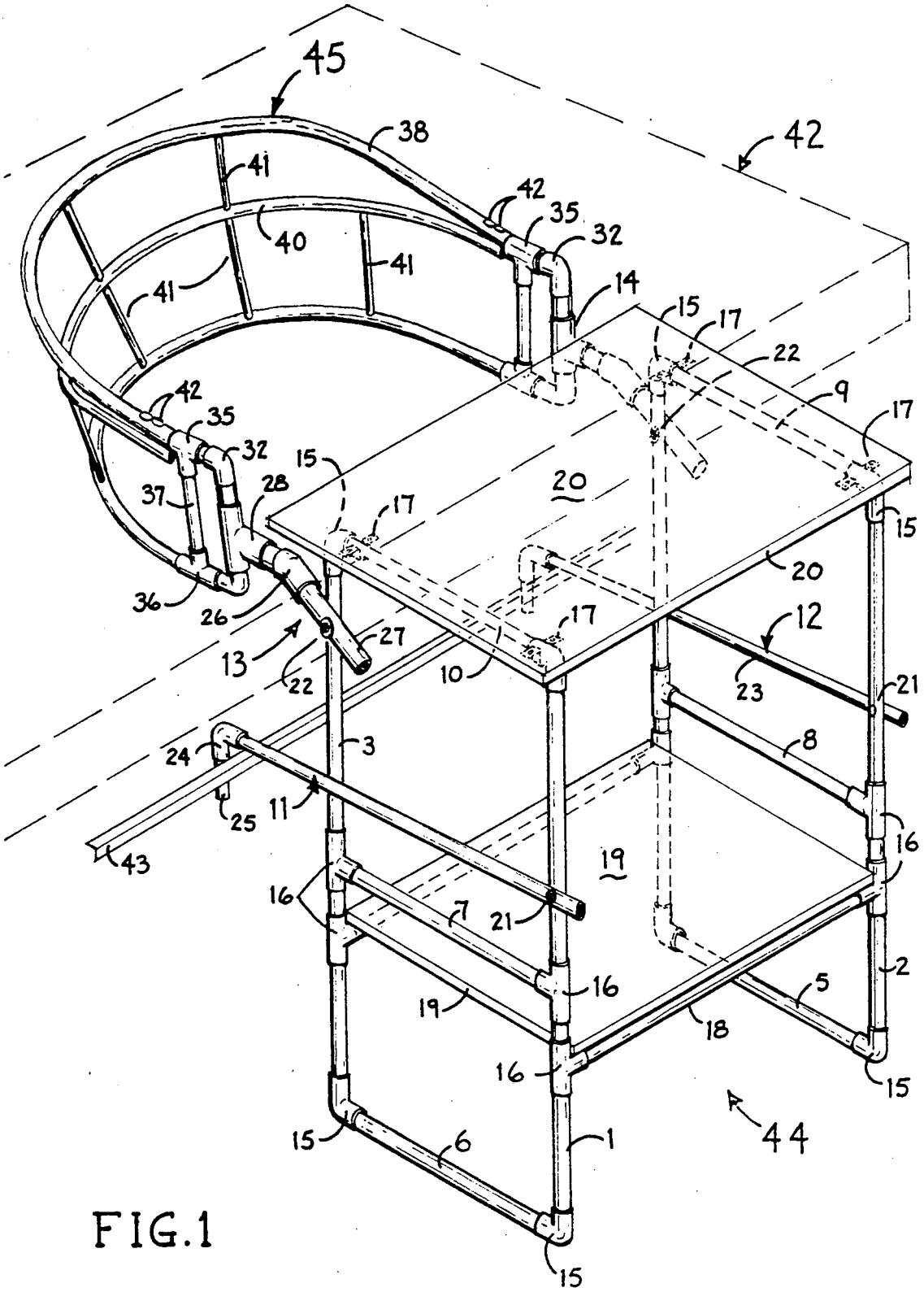
FIG. 1 is a perspective view of a preferred form of this invention.

Referring now to the various figures of the drawings, a new and improved combined bedchair, tray, and footrest construction is shown in FIG. 1 applied to a bed 42 having a bedrail 43.

The tray and footrest portion 44 of the device, consists of a rectangular frame having four vertical corner posts 1, 2, 3, and 4, each made from three pipe sections, which are interconnected by horizontal members 5, 6, 7, 8, 9, and 10 together with removable post connector and footrest supports 18. The posts and horizontal members are secured together by a series of "L" and "T" shaped connectors 15 and 16 respectively, to form a lightweight but strong and stable frame. To the upper horizontal members 9 and 10 is secured an easily removable, and adjustable if desired, tray or table top 20 by fasteners 17.

Figure 4:
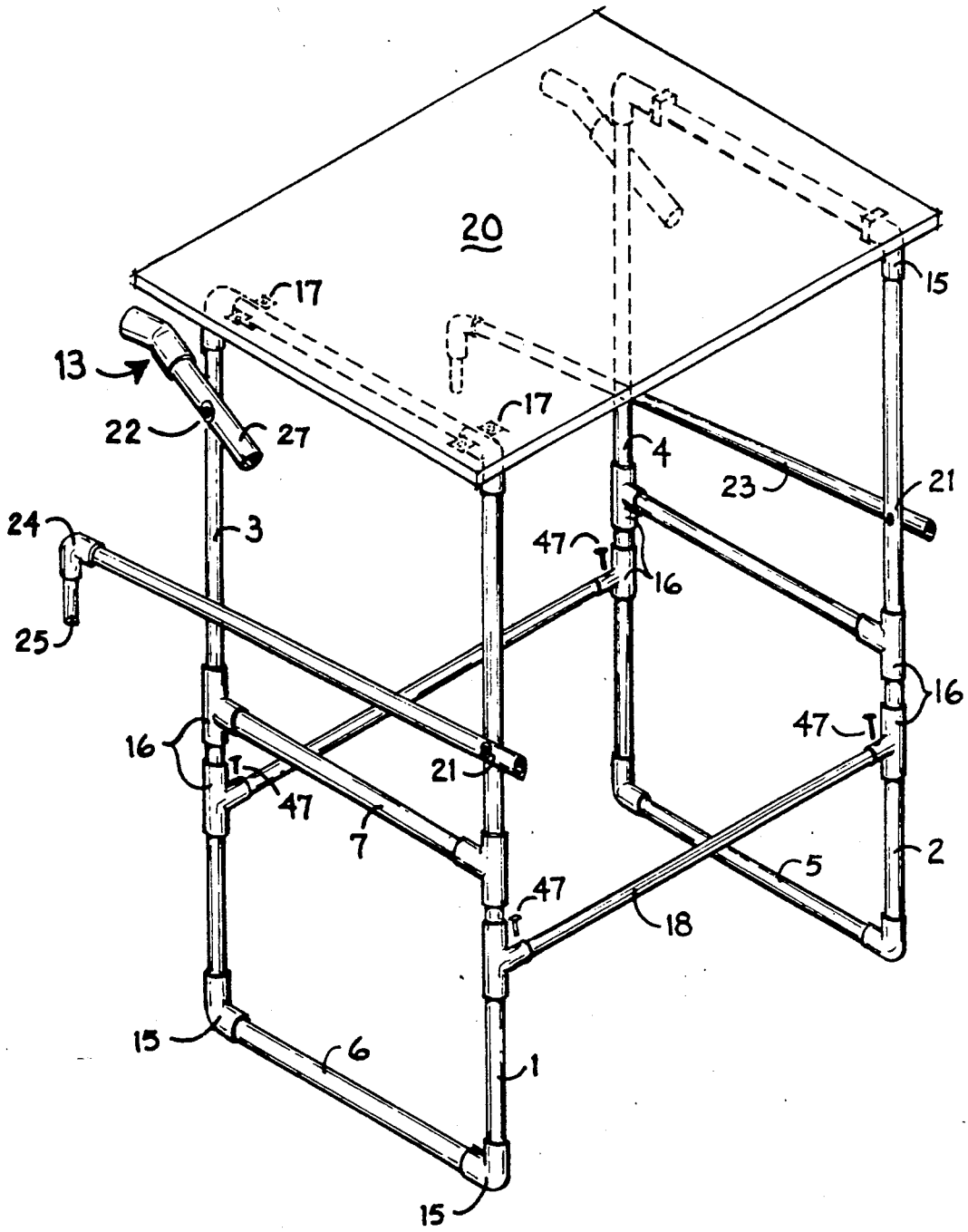
FIG. 4 is a view showing the removable connections which allow the table and footrest frame to be partly disassembled for portability.
Figure 5:
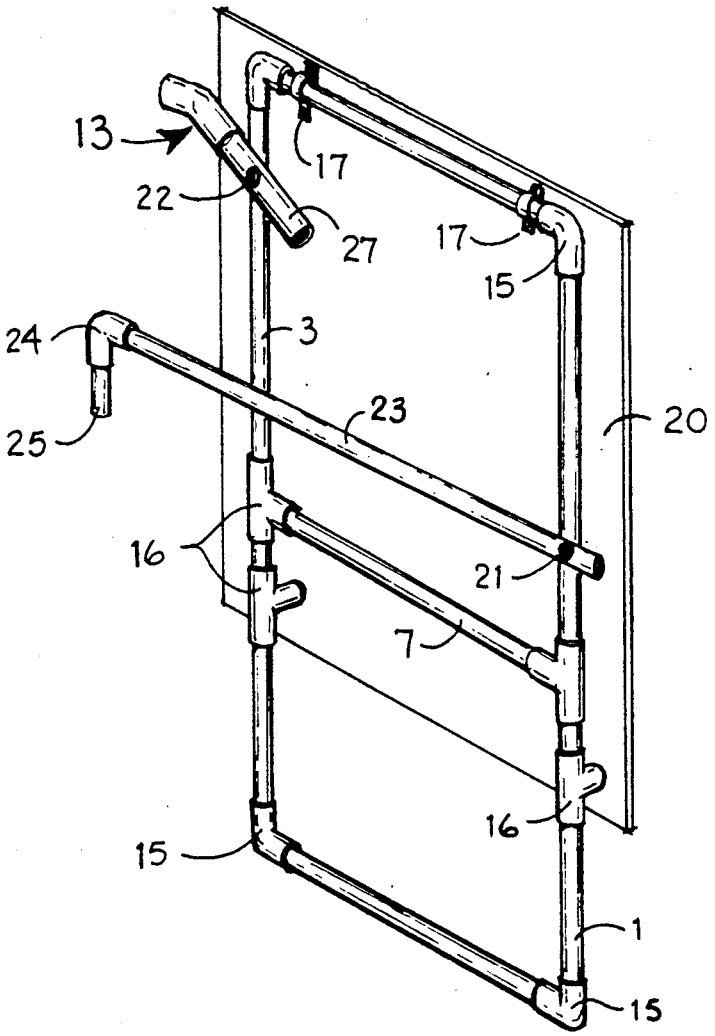
FIG. 5 is a view showing one side of the table frame with the table top member folded down.

The fasteners 17 are arranged so that they can be disconnected on one side, as at the top horizontal member 9, and the table top 20 pivoted with respect to the other top horizontal member 10 so that the device can be collapsed as shown in FIG. 5 for portability. The removable post connector and footrest support members 18 are secured to their respective "T" connectors 16 and the corner posts 1–4 by removable pins, or other suitable connector means 47, as indicated in FIG. 4.

A footrest 19, with concave corners for example, is removably secured to the intermediate horizontal footrest support members 18 which extend between and are connected to the four corner posts at an appropriate level.

To intermediate portions of the two front posts 1 and 2 are pivotally connected, at 21, two "L" shaped arms 11 and 12, one at each side, consisting of a long arm portion 23, a short arm portion 25, and an "L" connector 24 serving as hooks which are located to engage the bedrail 43 at each side of the device 44 and hold the tray and footrest in place with respect to the bed 42 and a patient sitting on the edge of the bed. Near the tops of the back corner posts 3 and 4 and below the tray, are pivotally connected, as at 22, two angled arm members 13 and 14 which serve to releasably secure a back and arm rest bedchair 45 in position on the bed and around a patient sitting on the edge of the bed with feet on the footrest 19.

The bedchair 45 includes upper, lower, and intermediate "U"-shaped members 38, 39, and 40, respectively, which are interconnected by spacers 41 around the back, fasteners 42, and "C" shaped connectors made of parts 31–37 as illustrated at the front of the bedchair where the "C" shaped connectors are adapted to be releasably connected to the two angled arm members 13 and 14.

Each of the angled arm members 13 and 14 includes a short section 27 pivotally connected at 22 to one of the back posts 3 and 4; a "T" shaped end portion 28 and a 45 degree angle section of pipe 26 connecting the sections 27 and end portions 28.

Each of the "C" shaped connectors at the front sides of the bedchair includes downwardly and upwardly extending ends 33 and 34 which are adapted to releasably snap-fit into upwardly and downwardly open recesses 29 and 30 of the "T" shaped end portions 28 of the angle arm members 13 and 14.

Figure 2:
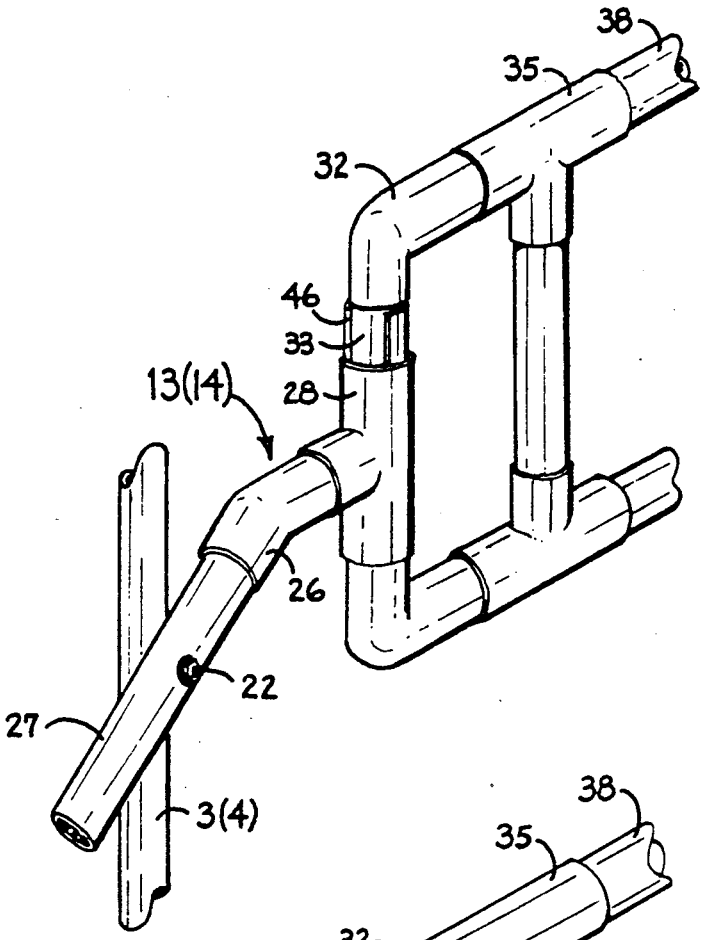
FIG. 2 is a partial view of the back support connection of the invention shown in FIG. 1.
Figure 3:
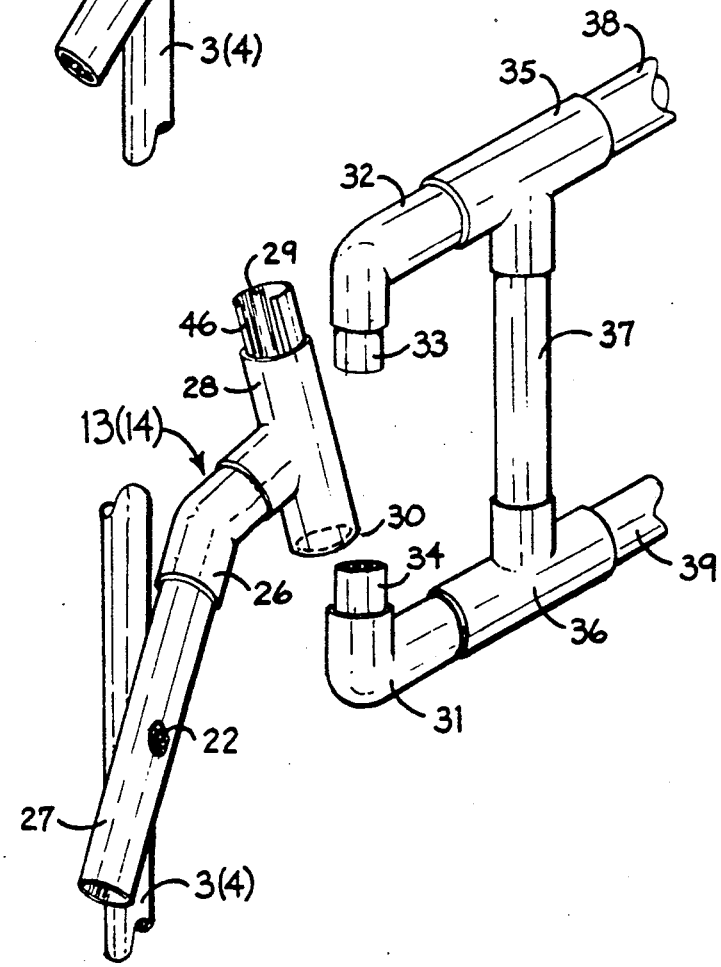
FIG. 3 is a view of the back support connection of FIG. 2 with the parts disconnected.

To be more precise arms 13 and 14 are pivoted so that recesses 30 fit over upwardly extending ends 34, and the downwardly extending ends 33 are then placed in front of upper recesses 29 and snap-fitted through vertical slots 46 in the walls of the recesses 29 as shown in FIGS. 2 and 3. The diameter of ends 33 is slightly greater than the width of the slots 46 in recesses 29 so that the bedchair is securely connected to the tray and footrest frame and pressure by the patient on the back support will further help to hold the tray and footrest frame 44 against the bed.

The above described "L"-shaped arms 11 and 12 when fitted over the bedrail 43 and secured in place, keeps the tray and footrest frame 44 securely in place adjacent to the bed and in front of the patient. Latch means associated with posts 3 and 4 or rail 43 can be used to hold arms 11 and 12 in position on the rail, and arms 23 can be made adjustable for various types of bedrails.

An additional feature which can be added for safety and privacy is heavy cloth screening or cushioning means which could be releasably secured around the inside of the frame between the tray and footrest to protect delicate skin on knees, legs, and feet and to provide for privacy. In addition, non-slip means could be placed on the lowermost frame members 5 and 6, for example, to prevent possible undesired movement.

At this point it should be pointed out that the invention herein described can be made from any suitable stock materials such as round or square PVC tube or pipe sections and PVC "L" and "T" sections which are readily available, easily cut and shaped, and secured together. For the back and armrest bedchair section a preferred material is P-Butylene.

The size and dimensions of the various component parts can be as necessary or desireable and would be readily apparent to ones skilled in this art. Likewise, the design of the tray can be such as to securely support food and drink containers.

Since various other modifications than those described above and illustrated on the drawings will become apparent, it is to be understood that the invention is not to be taken as limited except by the scope of the following claims.

I claim:

1. A combination bedchair, footrest, and tray device for a bedridden patient, said device being adapted to be releasably secured to a bed, and comprising a rectangular table and footrest frame resting on the floor and having four vertical corner posts, a plurality of horizontal connecting members securing the corner posts together and forming support means for an upper tray or table surface member and a lower footrest, a table surface member and a footrest secured to the frame at appropriate upper and lower locations, first arm means on the frame adapted to releasably and firmly secure the frame to the side of a bed, a patient back and side support bedchair member having a back and sides adapted to be releasably connected to the frame so as to rest on the bed and extend around the back of the patient supporting and allowing the patient to sit directly on the side of the bed, and second arm means mounted on the frame adapted to releasably connect the bedchair member to the frame such that the bedchair member will support the patient and bias the frame toward the bed.

2. A combination device, as set forth in claim 1, wherein said vertical corner posts are arranged as a pair of front corner posts remote from the bed and a second pair of corner posts adjacent to the bed, wherein the first arm means comprise "L"-shaped arms pivotally connected to the two front corner posts bed and adapted to hook over a side rail of the bed, the second arm means comprise angled arm members each having a pivot connection at one end to one of the two corner posts and a "T"-shaped connection member at the other end remote from the pivot connection having upwardly and downwardly extending ends with recesses and adapted to be firmly and releasably connected to the sides of the bedchair member.

3. A combination device, as set forth in claim 2, wherein the bedchair member comprises a plurality of vertically spaced "U"-shaped members having spaces there between defining a curved, upwardly, and backwardly inclined back portion and two side armrest portions which include end members of generally "C"-shaped configuration having downwardly and upwardly projecting end portions adapted to engage and be releasably secured to recesses in the upwardly and downwardly extending ends of the "T"-shaped connection members of the second arm means.

4. A combination bedchair, footrest, and tray device, as set forth in claim 3, wherein the recesses in the upwardly extending ends of the "T"-shaped connection members include narrow, vertical slots facing the tray to receive the downwardly projecting end portions of the "C"-shaped end members so as to facilitate connection of the "C" and "T"-shaped connection members.

5. A combination device, as set forth in claim 1, wherein the bedchair member comprises a plurality of vertically spaced "U"-shaped members having spacers there between defining a curved and upwardly extending back portion and side portions, the side portions including end members of generally "C"-shaped having end portions adapted to releasably engage, and be secured to, the second arm means.

6. A combination device as set forth in claim 1, which includes removable connector means associated with the table or tray member and the footrest support means such that the parts of the table and footrest frame can be at least partly disassembled and collapsed for portibility purposes.

* * * * *